US005394921A

United States Patent [19]

Lohausen

[11] Patent Number: 5,394,921

[45] Date of Patent: Mar. 7, 1995

[54] ARTICULATED ARM AWNING

[76] Inventor: Viktor Lohausen, Am Lerchenberg 28, D-7101 Oberheinriet, Germany

[21] Appl. No.: 923,784

[22] PCT Filed: Apr. 18, 1991

[86] PCT No.: PCT/EP91/00746

§ 371 Date: Jun. 29, 1993

§ 102(e) Date: Jun. 29, 1993

[87] PCT Pub. No.: WO91/17329

PCT Pub. Date: Nov. 14, 1991

[30] Foreign Application Priority Data

May 9, 1990 [DE] Germany ..... 40 14 873.4
Feb. 27, 1991 [DE] Germany ..... 41 06 032.6

[51] Int. Cl.[6] ..... E04F 10/00
[52] U.S. Cl. ..... 160/22; 160/66
[58] Field of Search ..... 160/66, 45, 22, 59, 160/70, 79, 81, 906, 905, 904, DIG. 5; 135/89

[56] References Cited

U.S. PATENT DOCUMENTS 3,991,805 11/1976 Clauss ..... 160/22
4,479,526 10/1984 Rinaldi et al. ..... 160/22
4,673,017 6/1987 Lauzier ..... 160/66 X
5,133,397 7/1992 Lohausen ..... 160/22

FOREIGN PATENT DOCUMENTS 194951 9/1986 European Pat. Off. .
500030 8/1992 European Pat. Off. ..... 160/45
2514941 10/1976 Germany .
2916496 11/1979 Germany .
3804150 8/1989 Germany ..... 160/45

*Primary Examiner*—Blair M. Johnson
*Attorney, Agent, or Firm*—Sughrue, Mion, Zinn, Macpeak & Seas

[57] ABSTRACT

The invention relates to an articulated arm awning with brackets for attachment of the awning and with holders for a cloth shaft with awning cloth which can be secured on the brackets. In order to permit particularly simple installation with slope adjustment, the holders (2) can be hung in at articulated fixing means (4, 5) of the brackets (1) and possess an approximately arc-shaped interior space in which a box with cloth shaft and awning cloth can be inserted and hung in, for example.

25 Claims, 6 Drawing Sheets

ARTICULATED ARM AWNING

The invention relates to an articulated arm awning with brackets for securing the awning to a wall or ceiling and with holders which can be secured on these brackets for a box accommodating the cloth shaft with awning cloth when necessary, whereby the holders can be hung in fixing means on the brackets in such a way that the brackets possess a hook-shaped, upward-facing projection at their bottom ends into which a strip projecting at the rear bottom ends of the holders can be hung. Such an arrangement is shown in DE-A-29 16 496, for example.

In addition, an articulated arm awning of this type is known from DE 25 14 941 C 3, for example. There, an awning with a self-supporting awning box is described which is secured to wall brackets with oblong holes by way of wall holders which encompass the awning box with stirrup supports, whereby the slope of the awning can be adjusted.

On the one hand, attachment of this articulated arm awning and slope adjustment are complex and capable of being changed only with difficulty. On the other hand, the awning box is relatively large and thus requires a large amount of material and is quite heavy.

The task of the invention is to create an articulated arm awning of the type mentioned at the start which is easier and simpler to secure and where slope adjustment is easier and which also consists of fewer parts overall.

The task of the invention is solved by the characteristics of patent claim 1.

Further characteristics of the invention are described individually in the other patent claims.

Figure 1:
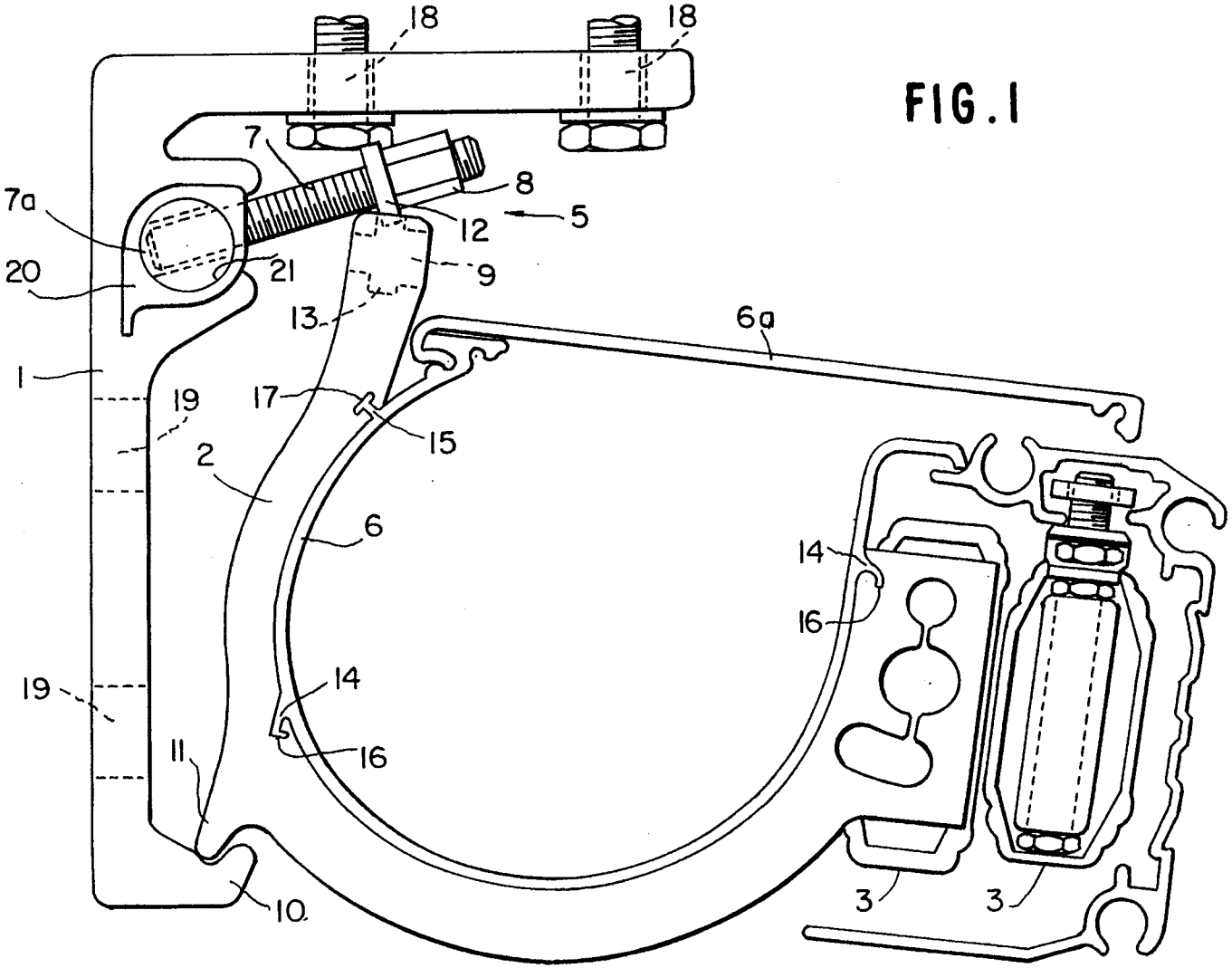
Figure 2:
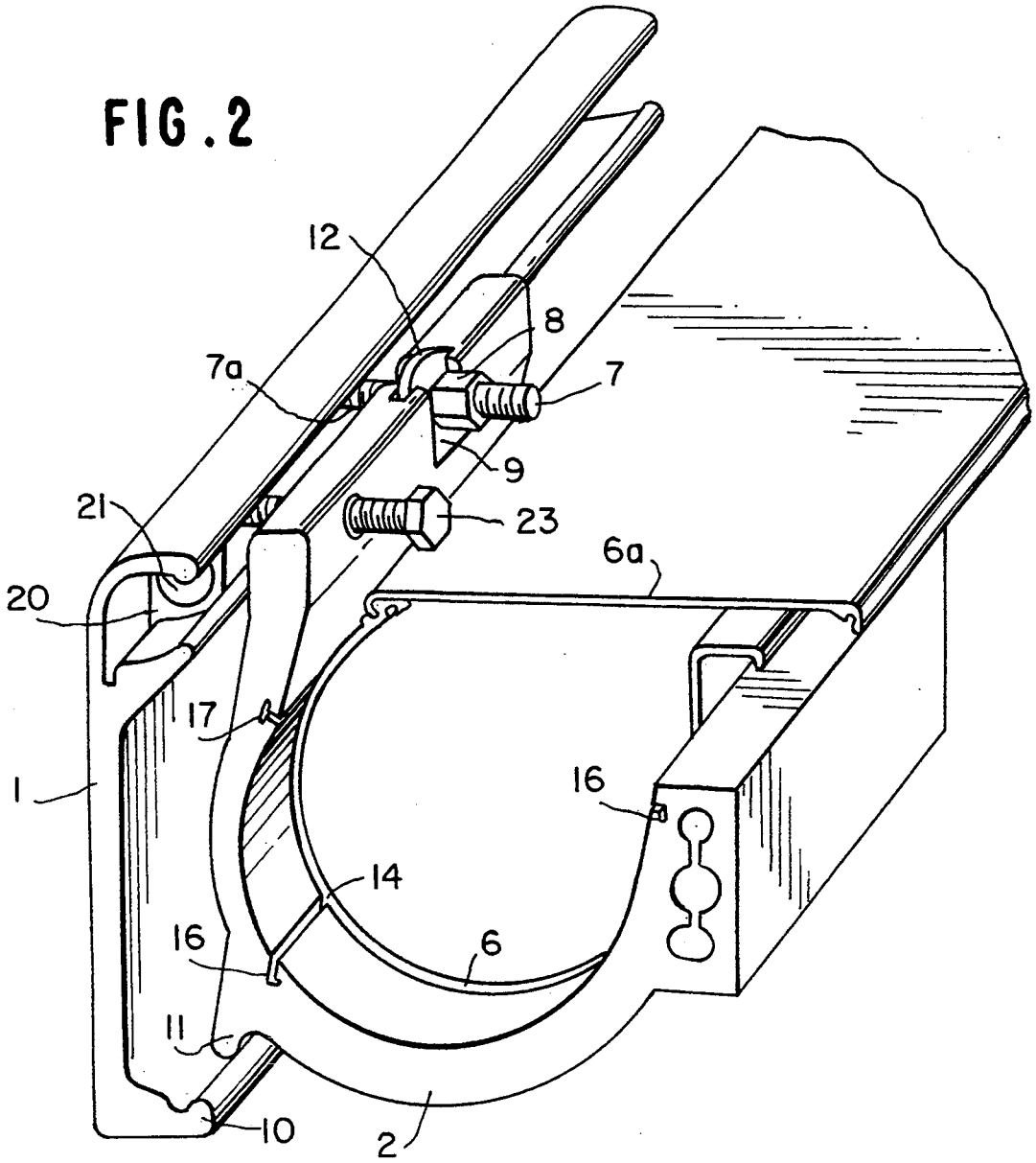
Figure 3:
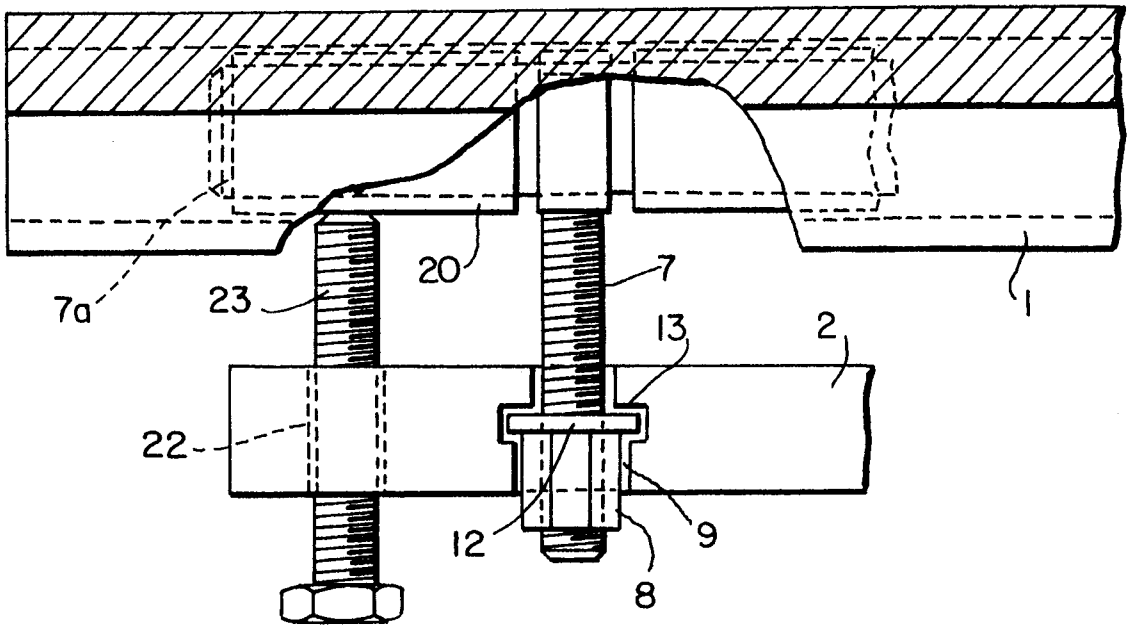
Figure 4:
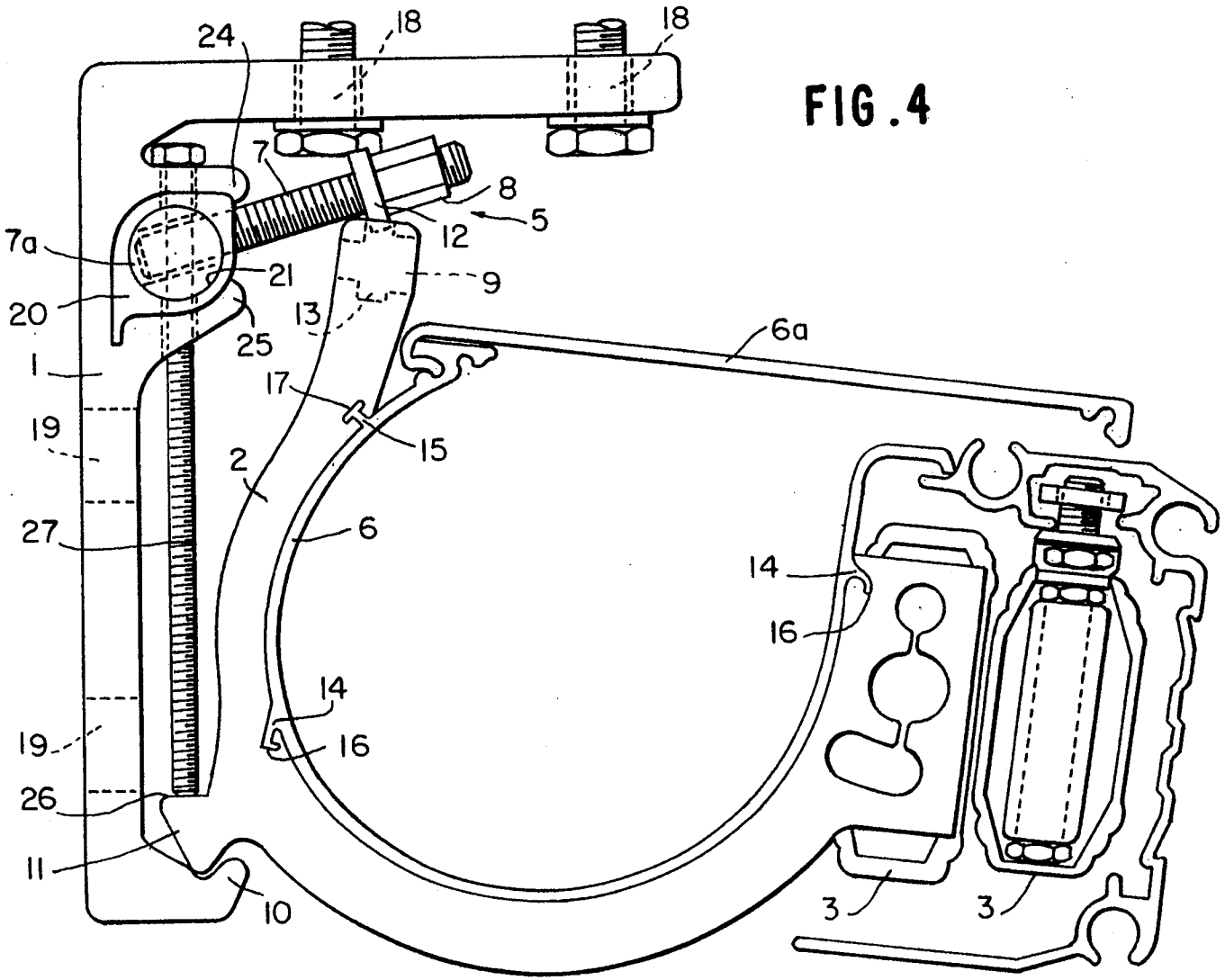
Figure 5:
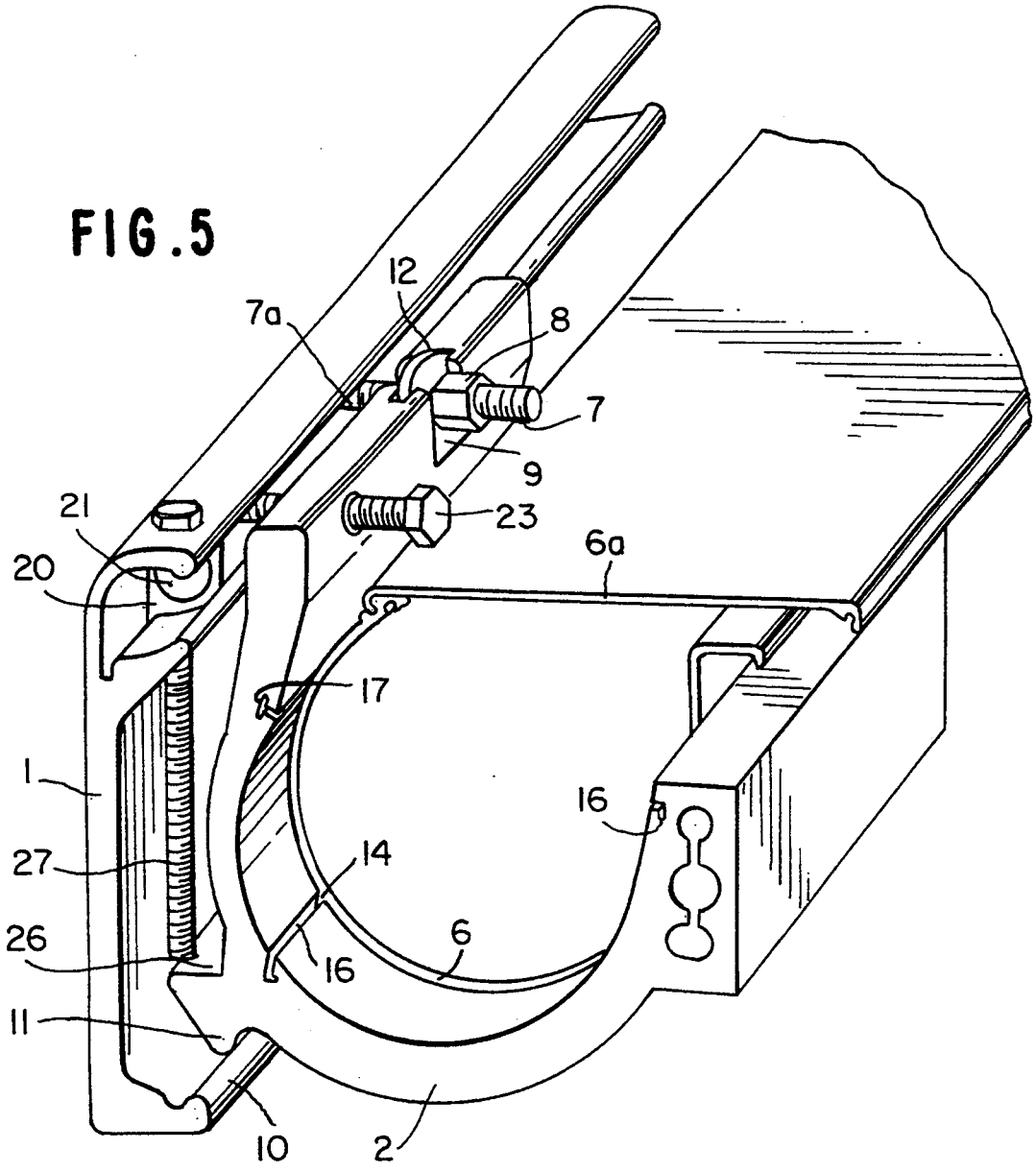
Figure 7:
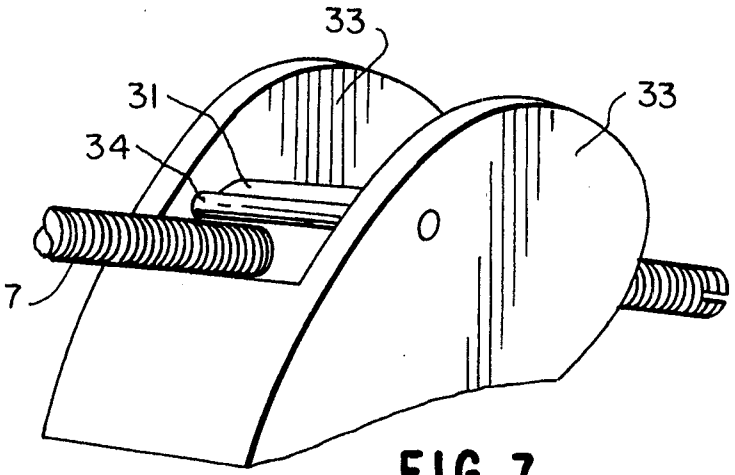
Figure 6:
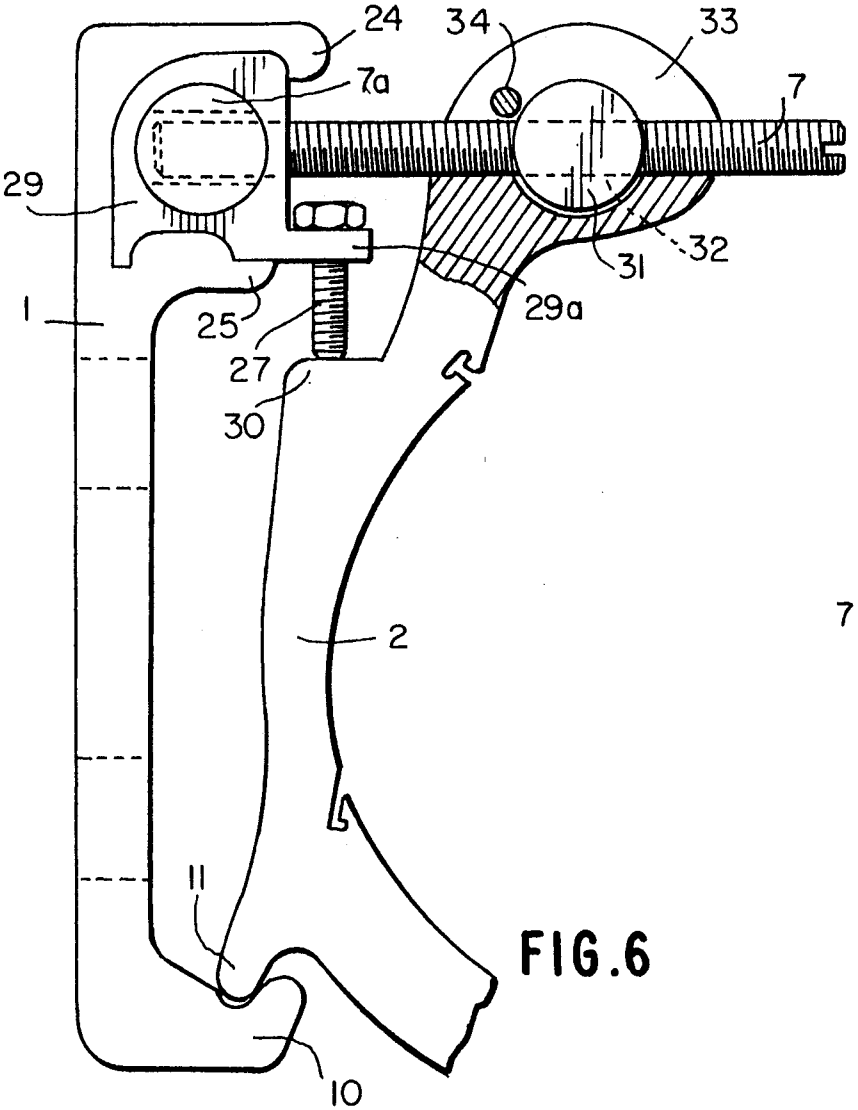

FIG. 1 a schematic sectional view of the new articulated arm awning;

FIG. 2 a perspective partial view of the articulated arm awning;

FIG. 3 a partial sectional view of the method of attachment of the articulated and pivoting screw bolt;

FIG. 4 a schematic side view of a further embodiment of the invention with a safety device;

FIG. 5 a schematic perspective partial view of the embodiment in accordance with FIG. 4;

FIG. 6 a schematic partial side view of a different embodiment of the invention and FIG. 7 a schematic perspective view of a detail in FIG. 6.

FIG. 1 shows a cross-section of an articulated arm awning, preferably a box awning with a bracket 1, which can be secured both on a wall and, in the corresponding design, on a ceiling. Ceiling mounting is intended in this case.

Holders 2 can be secured on this bracket 1, of which there are normally several, which possess articulated arms 3 at their front end (only suggested here). These holders can be secured on the bracket 1 by way of fixing means 4 and 5. A box 6 with a roof 6*a* can be inserted in these holders, for example, whereby this box may consist of a flexible material, preferably thin metal sheet. In the embodiment described here as an example only, this box 6 comprises one piece. However, it can also consist of several parts which can be assembled in circumferential direction.

The holders 2 are secured to the brackets 1 such that the screw bolts 7 are supported in the bracket 1 in a bearing 7*a* (i.e., is held in a bore 21 of a bearing 20), which will be described in detail later. An adjustment element, here a nut 8, is screwed onto this screw bolt 7 which can be inserted into a recess 9 in the holders 2.

The brackets 1 possess a hook-shaped projection or such a strip 10 at their bottom ends into which a corresponding strip 11 of the holders 2 can be inserted.

The nut 8 possesses a collar 12 at its rear end facing the bracket 1 which engages in a corresponding groove 13 in the recess 9 of the holders 2 when inserted, as shown in FIGS. 2 and 5. By turning the nut 8, relatively to the screw bolt 7 i.e. by turning the screw bolt 7, it is possible to adjust the tilt angle of the holders 2 with respect to the brackets 1 as a result of the resultant displacement of the nut 8.

The box 6 possesses hook-shaped, T-shaped projections or strips on its external circumference which are designated by 14 and 15 in the drawing. Other shapes are naturally also possible. The box 6 can be inserted in the corresponding hook-shaped openings. 16 or T-shaped grooves 17 by way of these strips or projections.

The dimensions are selected so that the box consisting of thin material adapts itself closely to the inner wall of the holders 2.

In the example embodiment described here, installation bolts 18 for ceiling mounting are shown.

The top, horizontal part of the brackets is not required for wall mounting. In this case, bores 19 are provided for wall mounting which permit wall mounting in conjunction with the installation bolts 18.

FIG. 2 shows more clearly attachment of a holder 2 to the bracket 1 in a partial sectional view. The same parts are again provided with identical reference numbers. It is possible to see clearly now how the screw bolt 7 with the fitted nut 8 and its collar 12 engages in the recess of the holder 2. In addition, it is possible to see the bearing 20, which possesses a bore 21 which can be used for a drive device if necessary. Inside bore 21, the bearing 7*a* is located. It holds the screw bolt 7. In addition, the locking screw 23 can be seen, this being screwed into the holder 2.

The holder 2 can be moved laterally within the bracket 1. The holder 2 can be fixed to prevent lateral displacement by tightening the locking screw 23. In addition, this ensures that the nut 8 with its collar 12 on the screw bolt 7 is clamped in its seat in the recess 9 of the holder 2. The nut 8 is prevented from becoming loose by being braced in this way.

This can be seen quite clearly once more in all details in FIG. 3. The same parts are again provided with identical reference numbers. The locking screw 23, which is inserted in a threaded bore 22 of the holder 2, ensures that the collar 12 of the nut 8 is pressed against the edge of the groove 13 when it is firmly tightened. As a result, this nut is clearly fixed on the screw bolt 7.

FIG. 4 shows a slightly modified embodiment of the invention with a safety device guaranteeing the hung-in condition of the holders 2 in the brackets 1. The same parts are again provided with identical reference numbers and do not require any special explanation. The nut 8 of the screw bolt 7 is shown in FIGS. 1 and 4 as swivelled out of the recess 9. By contrast, in FIGS. 2 and 5, it is already inserted for use.

Tongues or flanges 24, 25 form a channel 21 which is open to the front on bracket 1 into which the bearing 20 for the screw bolt 7 is inserted as in FIG. 1. As can be seen in detail in FIG. 5 in particular, flush threaded bores are provided in flanges 24 and 25 into which a locking screw 27 can be screwed.

For this purpose, the holder 2 possesses an approximately horizontal stop 26 at its rear bottom end, whereby this may take the form of a stop strip for example, on which the locking screw 27 can support itself. It is thus possible to prevent the holder 2 being lifted out of its hung-in position by tightening this locking screw 27.

This can be seen particularly clearly in FIG. 5, where the locking screw 27 is completely tightened. However, this design will mean that it would be possible to insert the displaceable bearing 20 7*a* from one side only where no locking screw locks the entrance of the bore 21.

This difficulty is avoided by the design shown in FIGS. 6 and 7 where the locking screw is put aside.

A sliding block 29 is inserted into the channel open to the front formed by flanges 24 and 25 which possesses a tongue 29*a* projecting to the front into which, in turn, the locking screw 27 can be screwed.

A rear-facing, approximately horizontal shoulder 30 is provided as a stop for this fixing screw or locking screw 27 in the rear top section of the holder 2 on which the holder 2 can be secured to prevent it from being lifted out. The sliding block 29 possesses on its rear side one or two strips which slide in a corresponding groove of the flanges 24 and 25 and which prevent the sliding block from falling out.

The sliding block 29 can consist of a separate part in addition to the bearing 20. However, it is preferable to manufacture the sliding block 29 and the bearing 20 for the swiveling and pivoting screw bolt 7 from one piece. This simplifies the design.

FIG. 7 shows a detail of how the screw bolt can also be inserted in a recess in the holder 2 and secured.

In this case, the recess consists of two side cheeks 33. A cylindrical guide 31 is provided here as an adjustment part which can be screwed onto the screw bolt 7, whereby this guide possesses a threaded bore 32 running transversely with respect to the longitudinal axis of the guide into which the screw bolt 7 can be screwed. After the screw bolt 7 screwed into the guide 31 has been hung in position, the screw bolt can be secured against lifting out by insertion of a locking pin 34. Bores are provided in the side cheeks 33 for this purpose, of which at least one must be a continuous bore, while the other may also be realized as a blind hole. The locking pin 34 is then inserted in this bore. After the screw bolt 7 equipped with the adjustment part has been hung in the recess of the holder 2, this thus ensures that lifting out of this recess is reliably prevented.

It is therefore evident that an articulated arm awning has been created through the invention which can be secured to a bracket in a particularly simple manner and which is suitable both for wall mounting and for ceiling mounting. The holders 2 used serve to hold a cloth shaft with awning cloth, for example in the form of a box, on the one hand, and on the other, to secure the articulated arms 3.

Other details of the articulated arm awning, particularly the drive mechanism and other details, are not shown, since they do not form part of the invention.

I claim:

1. An articulated arm awning comprising brackets for mounting an awning having articulated arms; and holders, which can be secured on the brackets to hold an awning shaft with an awning cloth mounted thereon, said brackets having a hook-shaped projection (10) facing upwards, each of said holders having a strip (11) projecting downwardly therefrom wherein the strip can be hung on said hook-shaped projection on the brackets (1) in such a way that the brackets (1) possess a pivoting and swiveling screw bolt mounted on an upper portion thereof (7) with an adjustment part (8, 31) which is threadedly attached to said bolt, wherein the adjustment parts are hung in a corresponding recess (9,33) located at a top end of the holders (2), and wherein the holders form an approximately arc-shaped interior space having a substantially horizontal center axis into which a box with said awning shaft and said awning cloth are inserted.

2. The articulated arm awning in accordance with claim 1, wherein one of said adjustment parts is a nut (8) which can be screwed onto the screw bolt (7), said nut possessing a collar (12) at its rear end which engages in a corresponding groove (13) of the recess (9).

3. The articulated arm awning in accordance with claim 2, further comprising a bearing (7*a*, 20) for the screw bolt (7) inside a chamber of the brackets (1) open to the front formed by two flanges (24, 25), wherein said bearing can be moved in lateral direction and can be fixed and tensioned in its corresponding position.

4. The articulated arm awning in accordance with claim 3, further comprising a locking screw (23), provided to fix the position of the screw bolt (7) to prevent lateral displacement and to secure the seat of the nut (8) with its collar (12) in the recess (9) and the groove (13) of the holders (2) to prevent this connection from becoming loose, wherein said locking screw can be pressed against the bearing (20), which can be moved in the chamber, inside the bracket (1).

5. The articulated arm awning in accordance with claim 2, further comprising a fixing screw (27), which can be screwed into a threaded bore, provided at the top end of the bracket, wherein said fixing screw can be used to fix the holder (2) in its hung-in position in conjunction with a stop (26, 30) on said holder facing to the rear.

6. The articulated arm awning in accordance with claim 5, further comprising a sliding block (29), which can be inserted in the chamber of the brackets, which possesses a tongue (29*a*) projecting to the front which in turn possesses a threaded bore to receive the fixing screw.

7. The articulated arm awning in accordance with claim 5, wherein the projecting strip (11) of the holder possesses a rear-facing shoulder (26) which acts as a stop for the fixing screw (27).

8. The articulated arm awning in accordance with claim 5, wherein the holder (2) possesses a rear-facing, approximately horizontal shoulder (30) in its top rear section which acts as a stop for the fixing screw (27).

9. The articulated arm awning in accordance with claim 5, further comprising a flush, continuous threaded bore provided through two flanges (24, 25) of the bracket (2) into which the fixing screw (27) can be screwed to fix the hung-in position of the holder (2) on the bracket (1) by contact with the holder.

10. The articulated arm awning in accordance with claim 1, wherein the recess at the top end of holder (2) is designed to accommodate a cylindrical guide (31) acting as an adjustment part, said guide possessing a threaded bore (32) located transversely with respect to the longitudinal axis of the guide to receive the screw bolt (7), so that the screw bolt (7) with the screwed on cylindrical guide can be hung in the holder recess.

11. The articulated arm awning in accordance with claim 9, wherein the recess is formed by two side cheeks (33), said recess accommodating a bore which passes completely through at least one of the two side cheeks and into which a locking pin (34) is insertable above the position of the screw bolt (7) hung in together with the cylindrical guide (31).

12. The articulated arm awning in accordance with claim 1, further comprising a box for the awning shaft and the awning cloth, which is insertable in the holders, said box being essentially self-supporting and is made of a thin material.

13. The articulated arm awning in accordance with claim 12, wherein the box (6, 6*a*) further comprises projections (14, 15) at several locations on its outer surface which can engage in corresponding recesses (16, 17) in the inner wall of the holder.

14. The articulated arm awning in accordance with claim 12, wherein the projections and recesses are designed such that the box (6, 6*a*) rests on the inner wall of the holders subject to mechanical pretension.

15. The articulated arm awning in accordance with claim 1 or 12, wherein the box (6, 6*a*) several parts in circumferential comprises direction which can be optionally connected with each other.

16. The articulated arm awning in accordance with claim 1, 2, or 5–13, wherein the articulated arms (3) are supported at the front outer ends of the holders (2) approximately symmetrical to the essentially horizontal center axis of the interior space of the holders (2).

17. The articulated arm awning in accordance with claim 3, further comprising a fixing screw (27), which can be screwed into a threaded bore, provided at the top end of the bracket, wherein said fixing screw can be used to fix the holder (2) in its hung-in position in conjunction with a stop (26, 30) on said holder facing to the rear.

18. The articulated arm awning in accordance with claim 17, further comprising a sliding block (29), which can be inserted in the chamber of the brackets, which possesses a tongue (29*a*) projecting to the front which in turn possesses a threaded bore to receive the fixing screw.

19. The articulated arm awning in accordance with claim 17, wherein the projecting strip (11) of the holder possesses a rear-facing shoulder (26) which acts as a stop for the fixing screw (27).

20. The articulated arm awning in accordance with claim 17, wherein the holder (2) possesses a rear-facing substantially horizontal shoulder (30) in its top rear section which acts as a stop for the fixing screw (27).

21. The articulated arm awning in accordance with claim 17, further comprising a flush continuous threaded bore provided through the two flanges (24, 25) of the bracket (2) into which the fixing screw (27) can be screwed to fix the hung-in position of the holder (2) on the bracket (1) by contact with the holder (at 26, at 30).

22. The articulated arm awning in accordance with claim 3, wherein the articulated arms (3) are supported at the front outer ends of the holders (2) substantially symmetrical to the substantially horizontal center axis of the interior space of the holders (2).

23. The articulated arm awning in accordance with claim 4, wherein the articulated arms (3) are supported at the front outer ends of the holders (2) substantially symmetrical to the substantially horizontal center axis of the interior space of the holders (2).

24. The articulated arm awning in accordance with claim 14, wherein the articulated arms (3) are supported at the front outer ends of the holders (2) substantially symmetrical to the substantially horizontal center axis of the interior space of the holders (2).

25. The articulated arm awning in accordance with claim 15, wherein the articulated arms (3) are supported at the front outer ends of the holders (2) substantially symmetrical to the substantially horizontal center axis of the interior space of the holders (2).

* * * * *